US007030569B2

(12) United States Patent
Gray

(10) Patent No.: US 7,030,569 B2
(45) Date of Patent: Apr. 18, 2006

(54) DIRECT DRIVE CCFL CIRCUIT WITH CONTROLLED START-UP MODE

(75) Inventor: Richard L. Gray, Saratoga, CA (US)

(73) Assignee: Analog Microelectronics, Inc., Santa Clara, CA (US)

( * ) Notice: Subject to any disclaimer, the term of this patent is extended or adjusted under 35 U.S.C. 154(b) by 208 days.

(21) Appl. No.: 10/688,427

(22) Filed: Oct. 16, 2003

(65) Prior Publication Data

US 2005/0093476 A1 May 5, 2005

(51) Int. Cl.
*H05B 37/02* (2006.01)

(52) U.S. Cl. ..... 315/224; 315/209 R; 315/291

(58) Field of Classification Search ..... 315/224, 315/209 R, 291, 307, 219
See application file for complete search history.

(56) References Cited

U.S. PATENT DOCUMENTS 5,619,402 A 4/1997 Liu ..... 363/98
5,680,017 A * 10/1997 Veldman et al. ..... 315/308
6,011,360 A * 1/2000 Gradzki et al. ..... 315/244
6,104,146 A 8/2000 Chou et al. ..... 315/271
6,259,615 B1 * 7/2001 Lin ..... 363/98
6,396,722 B1 5/2002 Lin ..... 363/20
6,804,129 B1 * 10/2004 Lin ..... 363/98

OTHER PUBLICATIONS

Henry: "LX1686 Direct Drive CCFL Inverter Design Reference", Microsemi Application Note AN-13, Microsemi Linfinity Division, Copyright 2000, Rev. 1.5.9.01, pp. 1-27.

* cited by examiner

*Primary Examiner*—Trinh Vo Dinh
(74) *Attorney, Agent, or Firm*—Bever, Hoffman & Harms, LLP; Jeanette S. Harms

(57) ABSTRACT

A CCFL can exhibit different strike characteristics depending on age and temperature. A CCFL in a direct driven CCFL circuit that is difficult to strike can appear to be malfunctioning using a standard start up operation. A controlled start up allows additional opportunities for a slow striking CCFL to strike. In one embodiment, the CCFL of the direct drive CCFL circuit can be initially driven at a switching frequency substantially different than a resonant frequency. Based on certain conditions, the switching frequency can subsequently be allowed to approach resonant frequency in a controlled manner. If the driving frequency reaches the resonant frequency of the CCFL during a set time period, then the CCFL can enter into steady state operation. At this point, the same conditions can be monitored to identify fault conditions in the direct drive CCFL circuit.

5 Claims, 12 Drawing Sheets

VREF
CE
SSC
RDELTA
SSC1ST
RT2
VSS
OVPH
OVPL
FCOMP
CSDET
BATTFB
PNP
SSV
BRIGHT
COMP
FB
CT1
VDD
BRPOL
VBATT
OUTA
OUTAPB
OUTC
C2
1μF
VDD
342
905
302
303
304
305
306
307
308
309
311
312
314
315
316
900
901
902
903
904
910
911
912
913
914
915
916
917
918
919
VDD

DIRECT DRIVE CCFL CIRCUIT WITH CONTROLLED START-UP MODE

BACKGROUND OF THE INVENTION

1. Field of the Invention

The present invention relates to cold cathode fluorescent lighting (CCFL), and particularly to a method of providing a controlled start-up mode.

2. Description of the Related Art

Liquid crystal displays (LCDs) are well known in the art of electronics. One of the largest power consuming devices in a notebook computer is the backlight for its LCD. The LCD typically uses a cold cathode fluorescent lamp (CCFL) for backlighting. However, the CCFL requires a high voltage AC supply for proper operation. Specifically, the CCFL generally requires 600 Vrms at approximately 50 kHz. Moreover, the start-up voltage of the CCFL can be twice as high as its normal operating voltage. Thus, over 1000 Vrms is needed to even initiate CCFL operation.

In optimal applications, the battery in the notebook computer must generate the high AC voltages required by the CCFL. To increase valuable battery life, those skilled in the art strive to provide an efficient means to convert this low voltage DC source into the necessary AC voltage. A magnetic transformer (hereinafter transformer) can provide the above-described conversion. CCFL circuits can leverage this transformer in various ways.

For example, FIG. 1 illustrates an exemplary Royer CCFL circuit 100 in which the emitters of NPN transistors Q1 and Q2 are coupled to an inductor whereas the collectors of NPN transistors Q1 and Q2 are connected to opposite ends of the primary winding of a transformer T1. A center tap of transformer T1 is connected to a battery (in this case, a 12 V source). A second primary winding of transformer T1 connects between the bases of NPN transistors Q1 and Q2. Other components, e.g. diodes D1/D2, resistors R1/R2, capacitor C1, and a 200 kHz oscillator, form a regulator circuit to control the current in the CCFL. In this configuration, Royer CCFL circuit 100 functions substantially as a fixed output voltage inverter, wherein its stepped up voltage at node 101 is proportional to the number of turns on the secondary winding divided by the number of turns on the primary winding.

Of importance, this stepped up voltage must be at least the striking voltage of the CCFL. Specifically, before strike (i.e. CCFL as an open circuit), no current flows through capacitor C3 and therefore the voltage across its terminals goes high (i.e. up to the strike voltage). However, after strike, current begins to flow across capacitor C3 and therefore its voltage across its terminals drops to a desired operating voltage.

FIG. 2A illustrates an exemplary direct drive CCFL circuit 200 in which the sources of n-type transistors Q5 and Q6 are coupled to ground whereas their drains are connected to opposite ends of the primary winding of a transformer T3. A p-type transistor Q4 is connected between a center tap of transformer T3 and a battery VBATT. Opposite ends of a secondary winding of transformer T3 are connected to ground and an input terminal of the CCFL. In one embodiment of direct drive CCFL circuit 200, transistors Q5 and Q6 have a duty cycle of 50% (e.g. between 0 and 5 V) whereas transistor Q4 has an adjustable duty cycle between 0% and 100% (e.g. VBATT—7.5 V and VBATT) (see FIG. 2B). In operation, direct drive CCFL circuit 200 effectively functions as a current source output. Specifically, as current is forced through the CCFL, an output voltage 201 will increase to ensure that current continues to flow. At start up of the CCFL, a voltage 201 increases until the CCFL strikes or some component in circuit 200 fails. After the CCFL strikes, the same current will flow in the CCFL, but the voltage will drop to a desired operating voltage.

Direct drive CCFL circuit 200 has several known advantages over Royer CCFL circuit 100. Specifically, direct drive CCFL circuit 200 typically can provide higher efficiency than Royer CCFL circuit 100 with fewer components. Moreover, unlike Royer CCFL circuit 100, direct drive CCFL circuit 200 can advantageously drive multiple CCFL tubes. For example, one known direct drive CCFL circuit having such capability is described in U.S. patent application Ser. No. 10/264,438, entitled "Method And System Of Driving A CCFL, filed on Oct. 3, 2002, which is incorporated by reference herein.

Direct drive circuits do not provide a fixed secondary voltage. Instead, the CCFL, not the driving circuitry, determines the secondary voltage. Because the CCFL effectively sets its own operating point (i.e. provides a self-biasing function), the user does not have to pick an operating voltage for the CCFL, choose the proper capacitance for the ballasting capacitor (e.g. capacitor C3 in Royer CCFL circuit 100), and then modify those values to ensure that enough power will be dissipated in the CCFL to provide adequate illumination. A CCFL-determined secondary voltage is generally considered advantageous because it eliminates the ballasting capacitor.

However, the striking characteristics of a CCFL appear to be a function of both age and temperature. That is, as a tube ages or under very cold conditions, a CCFL may not strike properly. Unfortunately, if the CCFL does not strike within a predetermined time, direct drive CCFL circuit 200 could conclude that a difficult to strike tube is instead a "bad" tube. That is, detect circuitry in direct drive CCFL circuit 200 could conclude that the tube was a safety hazard, and erroneously shut down the CCFL before striking at the new higher voltage.

To "coax" the CCFL into striking properly, some users prefer to hold the voltage across the CCFL at some higher than normal (yet still safe) voltage for a short period of time. Traditional direct drive CCFL circuits, because of their current source nature, are unable to provide a fixed voltage across a CCFL that has not yet struck.

Therefore, a need arises for a method of increasing the usable life from a CCFL as well as improving cold start operation while using a direct drive CCFL circuit.

SUMMARY OF THE INVENTION

A CCFL can exhibit different strike characteristics based on age and temperature. For example, a CCFL that is old or cold can take longer to strike. A CCFL in a direct driven CCFL circuit that is difficult to strike can appear to be malfunctioning using a standard start up operation. Therefore, in accordance with one feature of the invention, a start up operation of a direct drive CCFL circuit can be advantageously controlled to ensure that the CCFL is provided the opportunity to strike.

In one embodiment, the transformer and CCFL load of the direct drive CCFL circuit can be initially driven at a frequency substantially different than its resonant frequency. Based on certain conditions, the switching frequency can subsequently be allowed to approach resonant frequency in a controlled manner. The conditions can be monitored using an input voltage to the CCFL, a current through the CCFL (as indicated by an output voltage of the CCFL that is proportional to the current), and a resonant frequency of the CCFL/transformer combination.

In one embodiment, the input voltage of the CCFL can be monitored to determine whether the input voltage is equal to or less than a predetermined intermediate voltage. If so, then the switching frequency can be incrementally changed to approach the resonant frequency of the transformer/CCFL combination. However, if the input voltage is greater than the predetermined intermediate voltage but less than a predetermined high voltage, then the frequency can be held at its current value.

On the other hand, if the input voltage is above the predetermined high voltage, then the switching frequency can be reset to the initial frequency, e.g. a frequency substantially higher than the resonant frequency, and the start up operation can be repeated. The CCFL is characterized as "striking" when the CCFL current is equal to or greater than a predetermined value. In one embodiment, a timer can be set when the CCFL start up operation begins. If the timer has expired when either the input voltage is greater than the predetermined intermediate voltage or the CCFL current is less than a predetermined value, then the direct drive CCFL circuit can be shut down.

A method of monitoring for fault conditions in a direct drive CCFL circuit during steady state operation is also provided. Steady state operation is defined as operation after an initial start up period. In one embodiment, conditions similar to those in the start up operation can be monitored. For example, if the input voltage is greater than a predetermined intermediate voltage or the CCFL current is less than a predetermined value (as indicated by measuring an output voltage of the CCFL that is proportional to the current) for a predetermined number of clock cycles, then the direct drive CCFL circuit can be shut down. In one embodiment, if the input voltage is equal to or less than the predetermined intermediate voltage and the CCFL current is equal to or greater than the predetermined value, the switching frequency of the CCFL will decrease towards its resonant frequency. If the current frequency of the CCFL is not greater than a resonant frequency, then the current frequency can be held.

A method of transitioning from a start up to a steady state of a direct drive CCFL circuit is also provided. Specifically, after the CCFL in the direct drive CCFL circuit strikes, the CCFL can be forced to be at maximum brightness for a predetermined number of dimming cycles. After the predetermined number of dimming cycles, then fault monitoring can be enabled. A "dimming cycle" includes a period of time when the CCFL is on and a period of time when the CCFL is off. By varying the ratio of "on" to "off" time the average brightness of the tube may be adjusted. The period of a dimming cycle is often around 6 mS.

A circuit for determining current through multiple tubes in a direct drive CCFL system is also provided. The circuit can include means for determining a first output voltage from a first tube, wherein the first output voltage is proportional to a current through the first tube. The circuit can further include means for determining a second output voltage from a second tube, wherein the second output voltage is proportional to a current through the second tube. The circuit can further include means for combining the first and second output voltages as well as means for comparing the combined voltage to a predetermined voltage. The predetermined voltage (e.g. 1.25 V) is proportional to a current that indicates that either the multiple tubes have struck or one of the multiple tubes is unable to pass current.

The means for determining the first output voltage can include a first resistor coupled between a low voltage source and an output terminal of the first tube, and a first diode having a cathode connected to the first resistor and an anode connected to the means for combining. Similarly, the means for determining the second output voltage can include a second resistor coupled between the low voltage source and an output terminal of the second tube, and a second diode having a cathode connected to the second resistor and an anode connected to the means for combining.

The means for combining can include a third resistor coupled between a high voltage source and an anode of the first diode, a fourth resistor coupled between the high voltage source and an anode of the second diode, a third diode having an anode connected to the anode of the first diode and a cathode connected to the means for comparing, and a fourth diode having an anode connected to the anode of the second diode and a cathode connected to the means for comparing.

For each pair of tubes added to the circuit, additional resistor/diode pairs can be provided to determine output voltages of the tubes. In one embodiment, for each pair of tubes added to the circuit, the additional resistor/diode pairs are connected to the means for combining.

DETAILED DESCRIPTION OF THE FIGURES

In accordance with one feature of the invention, various conditions associated with a CCFL can be monitored. Based on these conditions, the switching frequency of a direct drive CCFL circuit can be appropriately controlled during a start up operation. This controlled start up allows additional opportunities for a slow striking CCFL to strike. In one embodiment, the controlled start up can be limited to a set time period, e.g. 1 second. If the CCFL strikes during the set time period, then the CCFL can enter into steady state operation. At this point, the same conditions can be monitored to identify fault conditions in the direct drive CCFL circuit.

Figure 1:
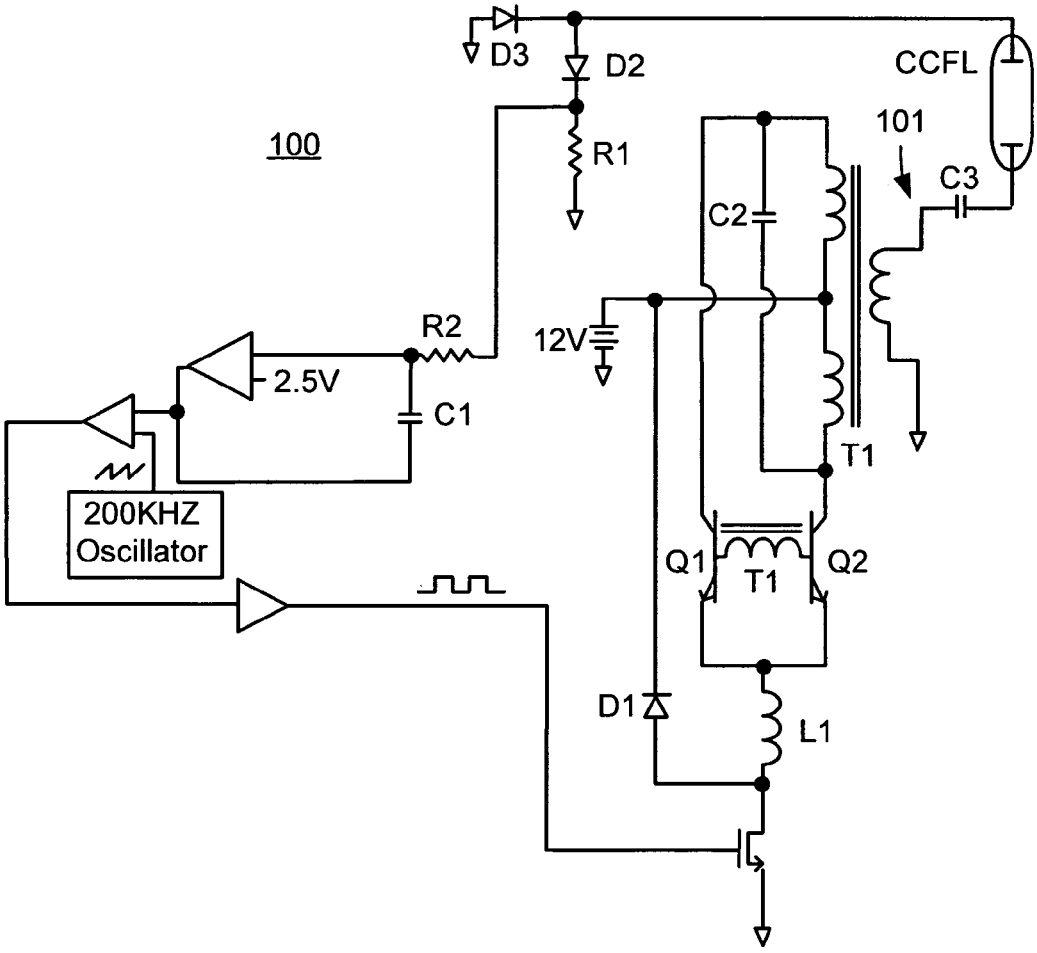
Figure 1 Prior Art
FIG. 1 illustrates an exemplary Royer CCFL circuit.
Figure 2A:
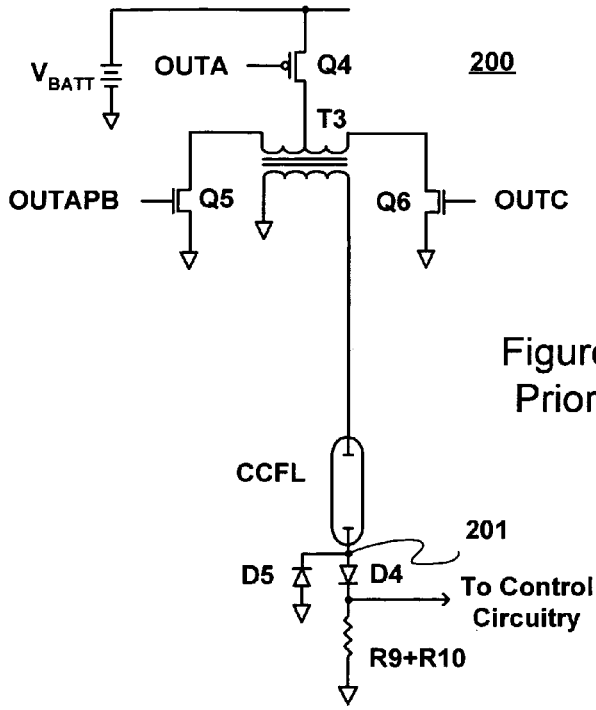
Figure 2A Prior Art
FIGS. 2A and 2B respectively illustrate an exemplary direct drive CCFL circuit and its associated waveforms.
Figure 2B:
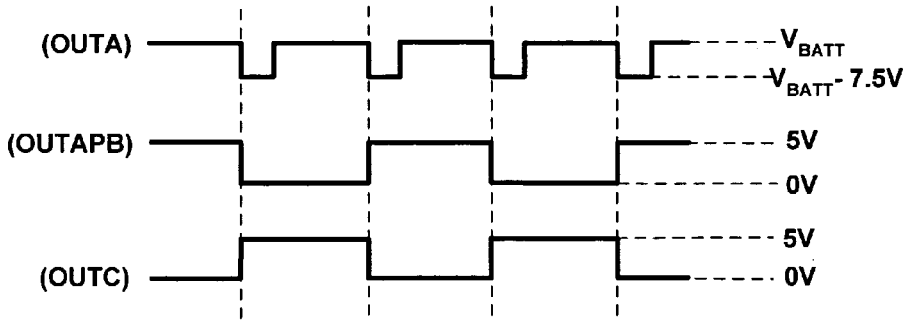
Figure 2B Prior Art
Figure 3:
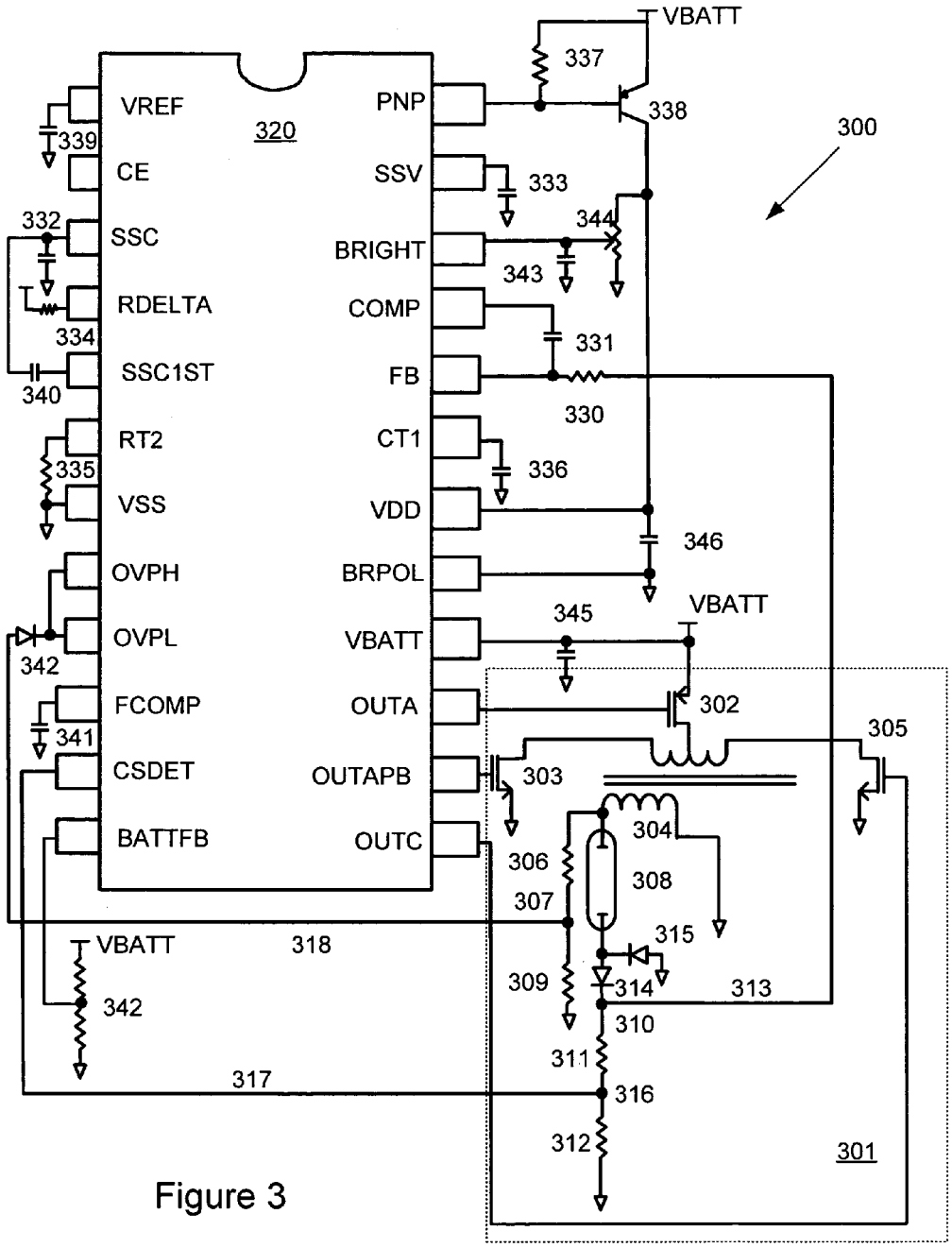
FIG. 3 illustrates an exemplary direct drive CCFL system that can control the start up operation of the CCFL.

FIG. 3 illustrates a direct drive CCFL system 300 including a direct drive CCFL circuit 301. In direct drive CCFL circuit 301, the sources of n-type transistors 303 and 305 are coupled to ground whereas their drains are connected to opposite ends of the primary winding of a transformer 304. A p-type transistor 302 is connected between a center tap of transformer 304 and a battery voltage VBATT. In one embodiment, the battery voltage VBATT can provide 7–24 V (typical for 3 lithium ion cells provided in a notebook computer application). Opposite ends of a secondary winding of transformer 304 are connected to ground and an input terminal of a CCFL 308. An output terminal of CCFL 308 is coupled (through diode rectifiers 314 and 315) to VSS via a pair of series-connected resistors 311 and 312.

Direct drive CCFL circuit 301 further includes a diode 314 with its anode connected to the output terminal of CCFL 308 and its cathode connected to resistor 311 as well as a diode 315 with its cathode connected to the output terminal of CCFL 308 and its anode connected to VSS. The current through CCFL 308 can be sensed on line 313, wherein the rectified voltage across resistor 311 (ensured by diodes 314 and 315) is proportional to the CCFL current. The current flowing through resistors 311 and 312 can be sensed at node 316 via line 317 at pin CSDET. Resistors 306 and 309 form a voltage divider so that the CCFL input voltage can be sensed at node 307 via line 318 and then converted from AC to DC using a rectifier (e.g. using a diode 342) to provide a voltage (at pins OVPH and OVPL) that is proportional to the CCFL input voltage.

In accordance with one feature of the invention, direct drive CCFL circuit 301 is initially operated at a switching frequency substantially different from its resonant frequency and then allowed to approach its resonant frequency in a controlled manner. The resonant frequency is determined by the parasitic inductances and capacitances associated with transformer 304 (as well as some parasitic capacitances associated with CCFL 308). In one embodiment, the initial switching frequency can be significantly higher than resonant frequency. This non-resonant switching frequency affects the operation of transformer 304 such that its output voltage provided to CCFL 308 can be controlled.

Of importance, while the switching frequency is approaching resonance, the voltage across the CCFL (as sensed at pins OVPH, OVPL) is continuously monitored. If the CCFL voltage exceeds some preset value, then the driving frequency is held constant until the voltage decreases below the preset value. If the CCFL voltage exceeds another, higher, preset value, then the switching frequency is increased once again to its maximum where it stays until the CCFL voltage falls below the second higher threshold.

Figure 4A:
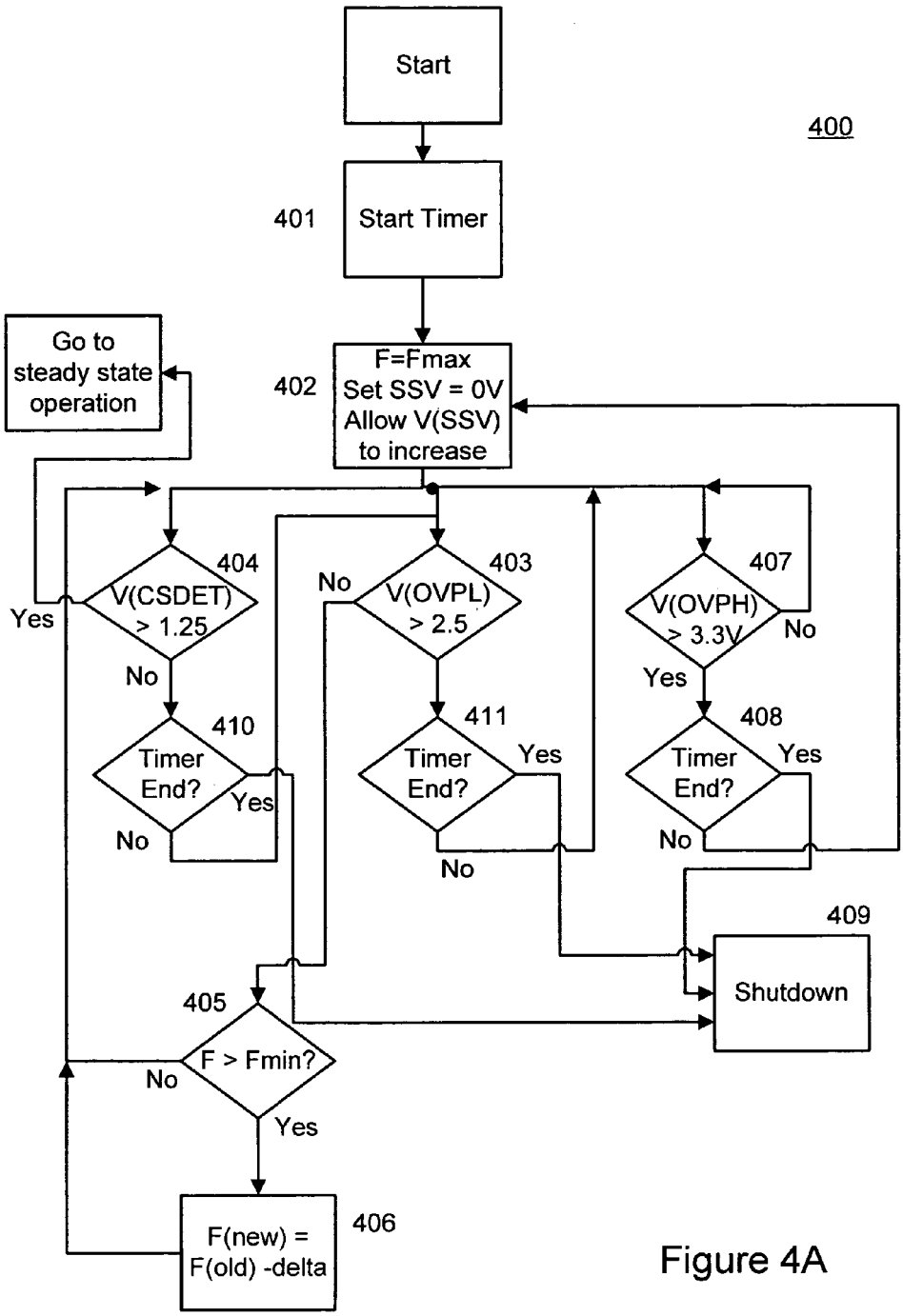
FIG. 4A illustrates a technique for controlling the frequency of the direct drive CCFL circuit during a start up operation.

FIG. 4A illustrates a method 400 of controlling the frequency of the direct drive CCFL circuit during a start up operation. In method 400, a timer is started in step 401. This timer monitors a maximum time for a start up period of the CCFL. As explained below, if that time period is exceeded without the CCFL establishing normal operation, then the driving circuitry shuts the circuit down to avoid a possible safety hazard. In one embodiment, this time period is set to 1 second.

In step 402, the switching frequency is set to its maximum setting and SSV is set to 0 V. The voltage at the SSV pin controls the maximum duty cycle of the switching waveform at pin OUTA. It does this by clamping the COMP pin to a voltage no higher than its own voltage. When the voltage at SSV is 0V, the duty cycle at OUTA is 0%. As SSV increases, the duty cycle of OUTA is also allowed to increase.

The next three steps, 403, 404, 407 can be checked concurrently. Step 404 determines whether the voltage at pin CSDET (i.e. an output voltage of the CCFL that is proportional to the current through the CCFL) is less than a predetermined low voltage. In one embodiment, the low voltage is 1.25 V. If the voltage at pin CSDET is equal to or greater than the low voltage, then the CCFL has struck and the process proceeds to steady state operation.

If the voltage at pin CSDET is less than a predetermined low voltage and the timer has not ended, as determined at step 410, then the control flow proceeds to step 403. Step 403 determines whether the voltage at pin OVPL (i.e. a voltage representative of the input voltage being provided to the CCFL) is greater than a predetermined intermediate voltage. In one embodiment, the intermediate voltage of the CCFL, as sensed through a resistor divider consisting of resistors 307 and 309 (see FIG. 3), is 2.5 V. At this step if the voltage at pin OVPL is not greater than the intermediate voltage, then step 405 determines whether the switching frequency of the direct drive CCFL circuit is greater than a predetermined minimum frequency (e.g. on the order of 50 kHz). If the switching frequency of the direct drive CCFL circuit is greater than a predetermined minimum frequency, then a new switching frequency is set in step 406. In one embodiment, this switching frequency is determined by subtracting an incremental frequency (delta) from the current switching frequency (F(old)). (In one embodiment, the voltage at pin FCOMP is allowed to rise, which lowers the switching frequency.)

If the voltage at pin OVPL is greater than the intermediate voltage (step 403), then step 411 determines whether the timer has ended. If the timer has ended, then the circuit shuts down in step 409. If the timer has not ended, then the switching frequency is held constant. In one embodiment, the voltage at FCOMP is not allowed to charge or discharge, which keeps the switching frequency constant.

Step 407 determines whether the voltage at pin OVPH is greater than a predetermined high voltage. In one embodiment, the predetermined high voltage threshold (proportional to the input CCFL voltage and sensed through a resistor divider including resistors 307 and 309) is 3.3 V.

If the voltage at pin OVPH is greater than the predetermined high voltage threshold and the timer has not ended (step 408), then the switching frequency is once again increased to its maximum setting and SSV is set to 0 V. In other words, if the input voltage to the CCFL is greater than this high voltage, thereby indicating that the process is not providing sufficient voltage control, then the switching frequency can be increased to the maximum frequency and the duty cycle of the switching waveform at pin OUTA will be reset to zero and then allowed to increase as SSV increases, thereby effectively restarting the CCFL. If the voltage at pin OVPH is not greater than the third predetermined voltage, then control returns to the concurrent steps 403, 404 and 407. If the timer ends, as determined by one of steps 408, 410 or 411 before the CCFL strikes, then the CCFL is probably defective and the start up process can be ended at step 409.

Thus, in summary, if a resistor divided representation of the CCFL input voltage is between a predetermined high voltage (e.g. 3.3 V) and a predetermined intermediate voltage (2.5 V), then the switching frequency is held constant. If a resistor divided representation of the CCFL input voltage is less than the predetermined intermediate voltage then the switching frequency will decrease until it reaches its preset minimum frequency. Note that after a significant current is detected in the CCFL, which in the above-described embodiment occurs when the voltage at pin CSDET is greater than 1.25 V, then the driving circuitry will move into a steady state operating mode. The steady state operating mode includes a switching frequency close to resonance.

Figure 4B:
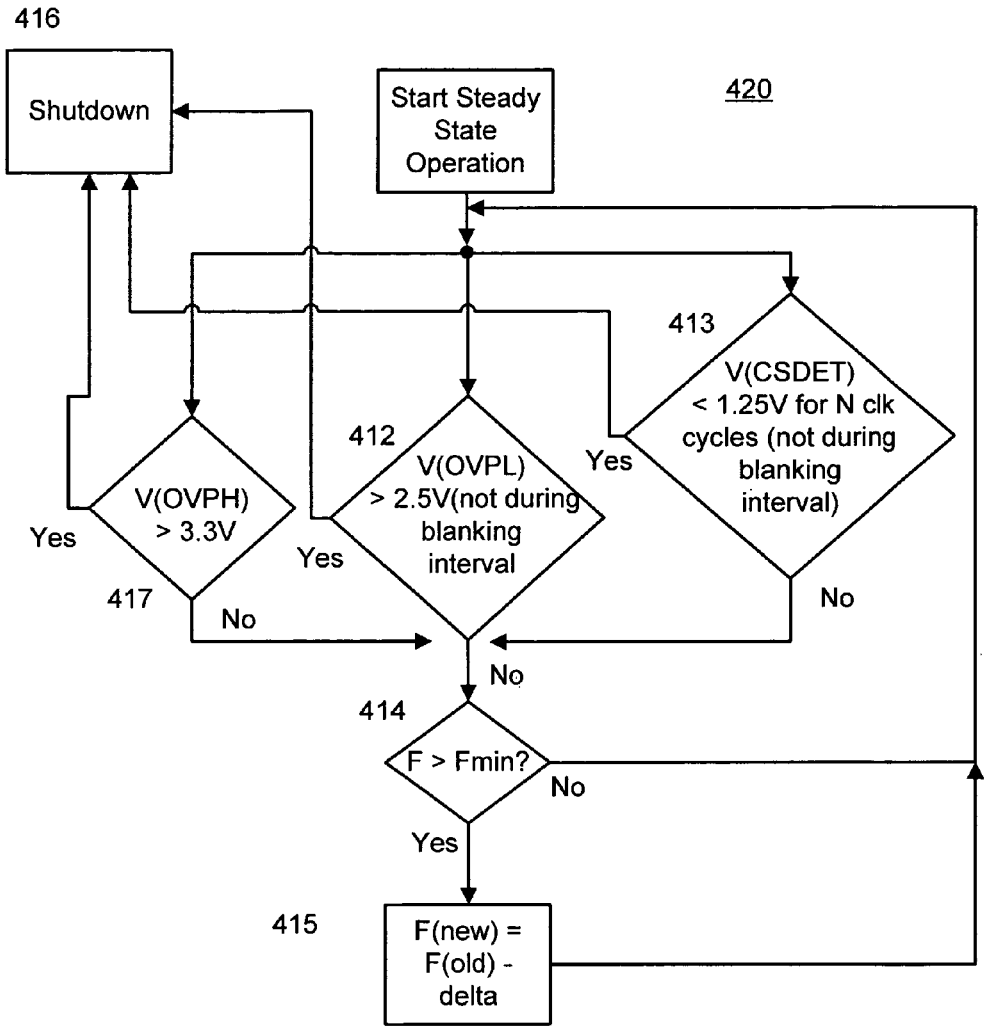
FIG. 4B illustrates an exemplary steady state operation in which various conditions associated with the CCFL can be monitored.

In a steady state operating mode, normal fault protections can be enabled. For example, FIG. 4B illustrates an exemplary steady state operation 420 in which the current through the CCFL, as detected by the voltage at pin CSDET, can be monitored. Of importance, when the circuit is first enabled, such fault protections can be disabled to allow the CCFL (even a reluctant CCFL) to strike. Advantageously, in a steady state operating mode, the same voltages/frequencies that were used to adjust the switching frequency during the start up mode can be used to detect fault conditions. In one embodiment, three fault conditions after the CCFL has struck can be detected.

In FIG. 4B steps 417, 412 and 413 are tested concurrently. Step 417 determines whether the voltage at pin OVPH is greater than the predetermined high voltage, e.g. 3.3V. Step 412 determines whether the voltage at pin OVPL is greater than the predetermined intermediate voltage, e.g. 2.5 V. In one embodiment, this check will only be performed after a normal blanking period. In other words, this check can be disabled at the beginning of each dimming cycle and when the CCFL is turned off during a dimming cycle. Step 413 determines whether the voltage at pin CSDET is less than the predetermined low voltage, e.g. 1.25 V, and whether N clock cycles have ended. In one embodiment, N can be set to 4 and begins to count only after a normal blanking period. (By requiring the fault to be present for N consecutive clock cycles the circuit can avoid incorrectly triggering a fault on the basis of one or two aberrant signals.) In other words, this check can also be disabled during blanking periods. If any of the checks in steps 417, 412, and 413 are positive, then the CCFL is shut down in step 416. In contrast, if any of the checks in steps 417, 412, and 413 are negative, then steady state operation 420 proceeds to step 414.

It is quite possible that the CCFL direct drive circuit will move from its startup mode to steady state operation before the switching frequency has decreased to its final preset minimum value. Steps 414 and 415 indicate that even in steady state operation the switching frequency can still decrease from a higher value down to its final minimum preset value near the resonant frequency of the CCFL/transformer network.

Figure 5:
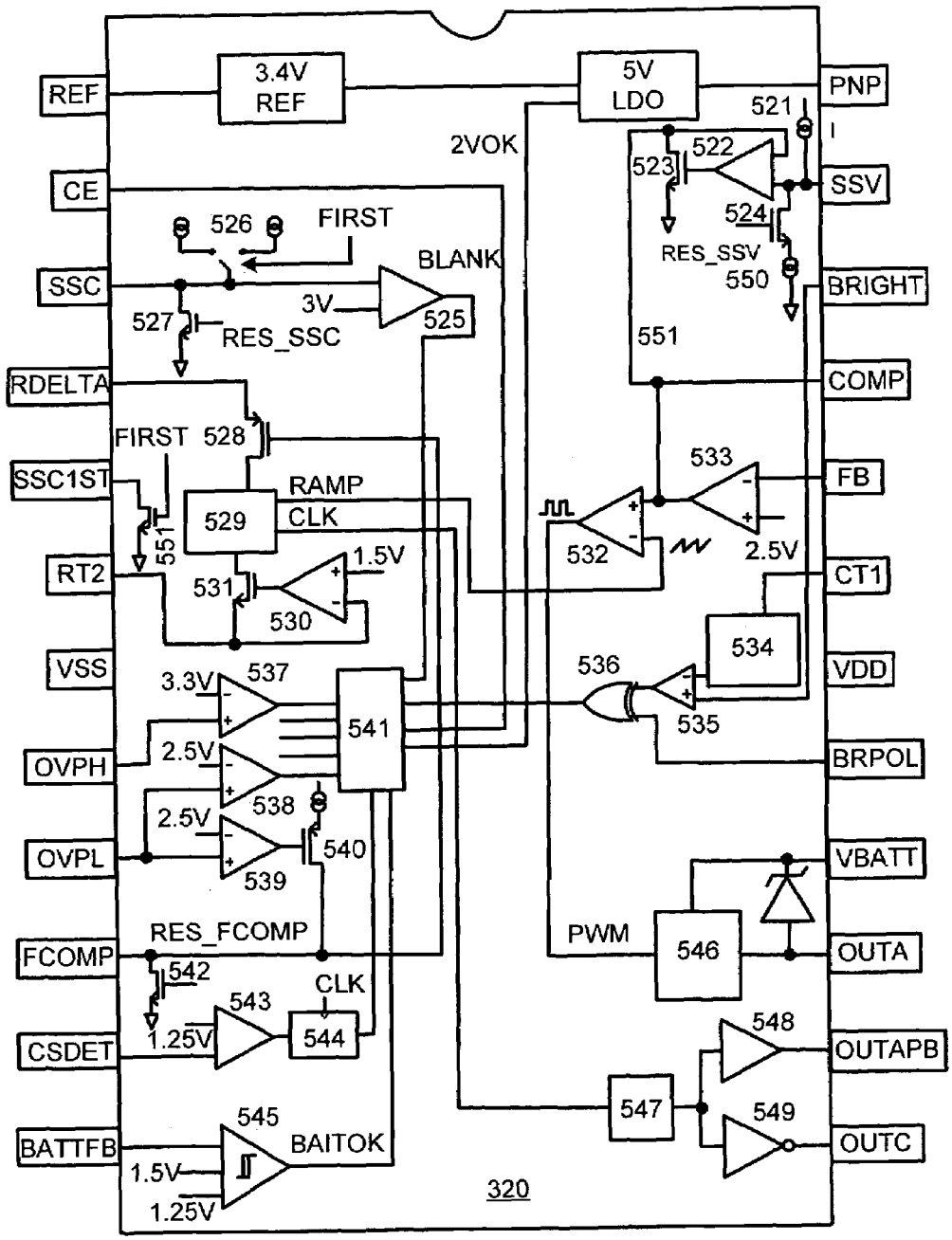
FIG. 5 illustrates another portion of a CCFL system.

FIG. 5 illustrates another portion of CCFL system 300 (FIG. 3), in particular a portion 320 that can be implemented using an integrated circuit chip. In this embodiment, a VCO 529 generates a CLK signal that, after being divided by 2 by T-type flip-flop 547, drives buffers 548 and 549 (wherein buffer 549 is of opposite polarity to 548). The outputs of buffers 548 and 549, in turn, drive NMOS transistors 303 and 305 of direct drive CCFL circuitry 301 (via pins OUTAPB and OUTC, respectively).

In this embodiment, a PMOS transistor 528, which is connected to an external resistor 334 (which in turn is connected to a positive supply (e.g. 5 V)) can control the current provided to VCO 529 (wherein the current determines the frequency range of VCO 529). Of importance, the voltage at the RDELTA pin follows the voltage at pin FCOMP. Specifically, as the voltage at pin FCOMP ramps higher, so does the voltage at pin RDELTA. A higher voltage at pin RDELTA passes less current through external resistor 334, thereby resulting in less current through PMOS transistor 528. Less current through PMOS transistor 528 results in less current into VCO 529 and ultimately slows the frequency of the RAMP and CLK signals. In contrast, a lower voltage at pin FCOMP increases the current through transistor 528, thereby increasing the current into VCO 529 and its generated frequency. Thus, PMOS transistor 528 effectively provides a frequency range for VCO 529. In one embodiment, the voltage at pin FCOMP can be reset to zero volts by applying an appropriate voltage RES_FCOMP to an NMOS transistor 542. A fault logic circuit 541 can generate this appropriate voltage RES_FCOMP.

A minimum frequency can also be set for VCO 529. In one embodiment, an error amplifier 530 can compare the voltage on pin RT2 to a set reference voltage and then output the difference between the two voltages as an amplified comparison result. When an external resistor 335 is applied between pins RT2 and VSS, error amp 530 will drive NMOS transistor 531 such that the voltage at pin RT2 remains at 1.5 V. The current through NMOS transistor 531 and into VCO 529 is then 1.5 V divided by the value of resistor 335. This current sets the minimum frequency of VCO 529. Resistor 335 is selected so that the minimum frequency of VCO 529 is near the resonant frequency of the transformer/CCFL network.

Fault logic circuit 541 is controlled in part by the voltages on pins OVPH and OVPL. Specifically, the voltage on pin OVPH is provided to a comparator 537, which compares that input voltage to the above-described high voltage, e.g. 3.3 V. The voltage on pin OVPL is provided to comparators 538 and 539, which each compare that voltage to the above-described intermediate voltage, e.g. 2.5 V. Note that the output of error amplifier 539 controls the gate of a PMOS transistor 540, which when turned on, allows a capacitor 341 connected to pin FCOMP to be charged up by a small current source. As the voltage at pin FCOMP rises, the VCO frequency falls. When PMOS transistor 540 turns off, the voltage at pin FCOMP, and hence the VCO frequency, does not change.

Fault circuit 541, using the outputs of error amplifiers 537 and 538, provides the functionality described in reference to FIGS. 4A and 4B. For example, fault circuit 541 generates an output signal RES_SSV that is provided to an NMOS transistor 524. When the RES_SSV signal is high, NMOS transistor 524 is on, thereby allowing a capacitor 333 connected to pin SSV to be discharged through current source 550. This discharge will limit the duty cycle of the PWM signal until driver OUTA is turned off completely. In contrast, when the RES_SSV signal is low, capacitor 333 is charged by current source 521, which allows driver 564 to drive pin OUTA at a larger duty cycle.

In this embodiment, the voltage at pin CSDET (which monitors the current through the CCFL) is provided to a comparator 543, which compares that voltage to the predetermined low voltage (e.g. 1.25 V). The output of comparator 543 resets a 2-bit counter 544 that would otherwise count upwards on every clock cycle. The output of 2-bit counter 544 can then be provided to fault logic circuit 541. If 2-bit counter 544 counts all the way to 4 in binary (or another predetermined power of 2) without being reset by comparator 543, then fault logic circuit 541 will interpret this condition as a fault and shut down the CCFL circuit. As explained below, faults generated in this fashion are ignored during the blanking interval.

In this CCFL system, a first control loop connected to pin COMP provides its DC signal to a positive terminal of a comparator 532. VCO 529 provides a signal RAMP (saw-tooth-waveform synchronous with the CLK signal) to a negative terminal of comparator 532, wherein the frequency of the RAMP signal is a function of the VCO control voltage. The output signal of comparator 532, i.e. a PWM signal (pulse width modulated), is provided to driver circuit 546. As the duty cycle of the PWM signal gets larger, driver 546 keeps external PMOS transistor 302 "on" for longer periods of time, which increases the power transferred to the CCFL. Note that the frequency of the RAMP signal generated by VCO 529 controls the frequency of the PWM signal generated by comparator 532.

As described above, the current through CCFL 308 can be sensed on line 313, wherein the rectified voltage across resistor 311/312 (ensured by diodes 314 and 315) is proportional to the CCFL current. That rectified voltage can drive an input of an integrator formed by resistor 330, capacitor 331, and an error amplifier 533. Specifically, the integrator receives the voltage on line 313 through a resistor 330, wherein resistor 330 is coupled to the negative terminal of error amplifier 533. Error amplifier 533 compares this voltage with a reference voltage, e.g. 2.5 V, received on its non-inverting terminal. Capacitor 331 is coupled to the negative terminal and the output terminal of error amplifier 533. The purpose of this integrator is to generate the above-described signal COMP such that the time-averaged voltage at node 310 is substantially equal to the 2.5 V reference voltage.

In one embodiment, a comparator 525 can generate a signal BLANK, which can notify fault logic circuit 541 to ignore certain fault conditions for a certain period of time. One input terminal of comparator 525 is coupled to one of two current sources 526 (e.g. one at 1 uA and another at 150 uA) as well as to terminals of capacitor 332 and capacitor 340 (via pin SSC). Capacitor 332 has its other terminal connected to VSS, whereas capacitor 340 has its other terminal connected to pin SSC1ST.

During a "cold" start-up operation of CCFL 308, i.e. a start-up following a predetermined period of time in which CCFL 308 has been off, fault logic circuit 541 can generate a signal FIRST, which selects the lower value current source and turns on an NMOS transistor 551 connected to pin SSC1ST. In contrast, during subsequent "warm" starts, i.e. a start-up following a time period less than the predetermined period of time, fault logic circuit 541 drives the FIRST signal low, which selects the higher value current source and turns off NMOS transistor 551. In this manner, the voltage ramp at pin SSC is much slower during a cold start-up than a warm start-up. The much slower ramp can be used to provide the time period for the initial start up period (e.g. 1 sec). The signal RES_SSC discharges capacitors 332 and 340 at the end of each dimming cycle. In one embodiment, fault logic circuit 541 can generate the RES_SSC signal.

If the voltage on pin SSC is greater than the 3 V reference voltage, then the signal BLANK goes low, which indicates the end of the blanking period. On the other hand, if the voltage on pin SSC is less than the 3 V reference voltage, then the signal BLANK is high, which indicates that the blanking interval is in effect. The first blanking interval also serves as the timer for the initial start up period (e.g. 1 second).

In one embodiment, the signal provided to the positive input terminal of comparator 532 (i.e. the signal on line 551) can be limited by a clamping circuit. This clamping circuit can includes an error amplifier 522, which provides an output signal to the gate of an NMOS transistor 523. NMOS transistor 523 has its source coupled to VSS and its drain coupled to the positive input terminal of error amplifier 522 as well as to line 551. In this configuration, the clamping circuit allows the signal on line 551 to increase at a rate that is no faster than a selected current source 521 can charge a capacitor 333. The clamping circuit also shuts off the CCFL once every dimming cycle by reducing the switching duty cycle to zero.

In one embodiment, a ramp generator 534 can generate a sawtooth waveform that is limited by a small capacitor 336 (via pin CT1). A comparator 535 can compare this sawtooth waveform with a voltage on a BRIGHT pin (i.e. a brightness control voltage, which is proportional to the desired brightness). Based on this comparison, comparator 535 outputs a variable duty factor signal. An XOR (exclusive OR) gate 536 receives this variable duty factor signal as well as a voltage on a pin BRPOL. In this embodiment, a low signal BRPOL indicates normal operation, thereby allowing the variable duty factor signal to be transferred to fault logic circuit 541. When BRPOL is low, the CCFL gets brighter as the voltage at the BRIGHT pin increases. In contrast, a high signal BRPOL indicates reverse operation, thereby providing a signal opposite to that of the variable duty factor signal to be transferred to fault logic circuit 541. When BRPOL is high, the CCFL gets dimmer as the voltage at the BRIGHT pin increases.

Additional components can be included in CCFL system 300 as shown in FIG. 3. Specifically, additional components can include, for example, resistor 337, a pnp transistor 338, as well as capacitors 339, 345, and 265. Capacitor 339 can function to regulate the on-chip reference voltage (e.g. 3.4 V). Capacitor 346, pull-up resistor 337, and pnp transistor 338 form a linear regulator that can provide a VDD supply voltage from battery 101. Capacitor 345, in this embodiment can serve as a bypass capacitor, which effectively regulates the high AC current from battery 101.

Figure 6:
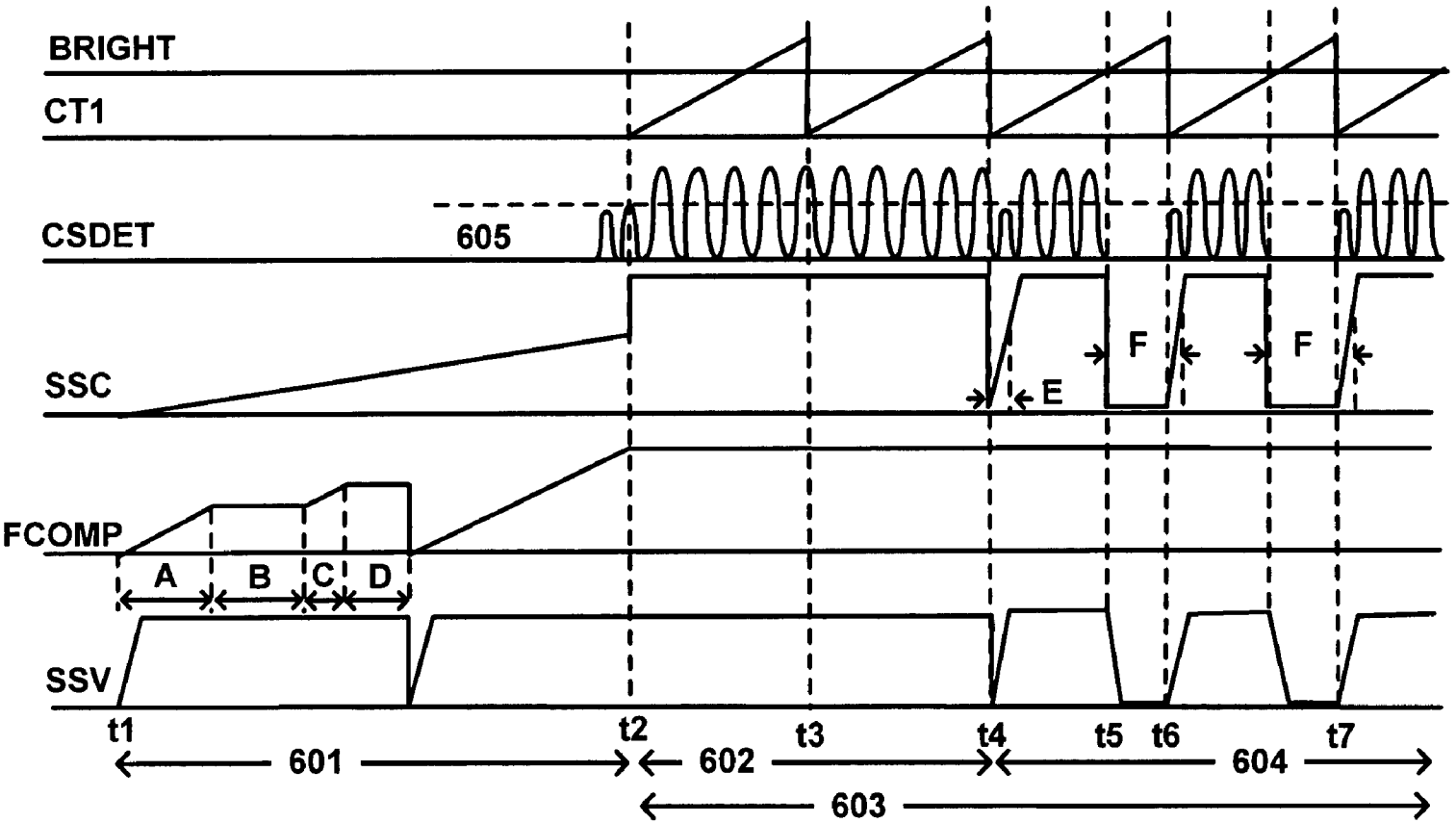
FIG. 6 illustrates an exemplary timing diagram for a CCFL system.

FIG. 6 illustrates an exemplary timing diagram 600 that includes an initial start up period 601 (i.e. from time t1 to time t2) and a post-strike period 603 (i.e. from time t2 to time t7). In the initial start up period 601, the voltage at pin FCOMP gradually increases during period A. Note that period A starts with FCOMP=0, which turns on PMOS transistor 528 (FIG. 5) and ensures that VCO 529 generates the maximum frequency. Period A corresponds with the conditions that the voltage at pin OVPL is not greater than 2.5 V (see step 403, FIG. 4A) and the voltage at pin CSDET is not greater than 1.25 V. (Note that if the voltage at CSDET is larger than 1.25 V, then the initial startup period ends and the circuit immediately moves to time point t2.) Therefore, the voltage at pin FCOMP can be increased, thereby decreasing the frequency of VCO 529.

During time period B, the voltage at pin OVPL is greater than 2.5 V, but the voltage at pin OVPH is not greater than 3.3 V (see step 407). Thus, during time period B, the voltage at pin FCOMP is maintained, thereby keeping the frequency of VCO 529 constant. When the voltage at pin OVPL drops below 2.5 V, the circuit transitions from period B to C. During time period C, the voltage at pin OVPL is not greater than 2.5 V (see step 403, FIG. 4A) and the voltage at pin CSDET is still less than 1.25 V. Therefore, the voltage at pin FCOMP increases, thereby decreasing the frequency of the VCO. During time period D, the voltage at pin OVPL is once again greater than 2.5 V, but the voltage at pin OVPH not greater than 3.3 V (see step 407). Thus, during time period D, the voltage at pin FCOMP is maintained, thereby keeping the frequency of the VCO constant.

At the end of time period D, the voltage at pin OVPH is momentarily greater than 3.3 V (see step 407). Therefore, a new start up operation is immediately triggered. This new start up period is shown by the voltages at pins FCOMP (which restarts at zero, thereby ensuring a maximum frequency in the VCO, and then steadily increases) and SSV (which resets the duty cycle, which is described below in further detail). This new start up period, which lasts until time t2, satisfies the conditions that the voltage at pin OVPL is not greater than 2.5 V (see step 403, FIG. 4A), the voltage at pin CSDET is not greater than 1.25 V and the voltage at pin OVPH is less than 3.3 V. Therefore, the voltage at pin FCOMP can be increased, thereby decreasing the frequency of the VCO.

At time t2, the voltage at pin CSDET is equal to or greater than 1.25 V (indicated by dashed line 605)(see step 404), thereby indicating that the CCFL has struck. Note that the voltage at pin FCOMP may or may not have reached 5 V at the time that the CCFL strikes. The voltage at pin FCOMP will continue to ramp positive at the same rate regardless of whether the CCFL has struck or not. In one embodiment resonant frequency is the set minimum frequency. Thus, time t2 begins post-strike period 603.

Once the CCFL strikes, a certain minimum time should expire to allow the CCFL to warm up. Unfortunately, users typically want to go immediately into duty cycle dimming. Duty cycle dimming, as used herein, refers to turning the CCFL on and off at a frequency that is faster than the human eye can discern but much slower than the switching frequency of the CCFL (e.g. the switching frequency is often near 50 kHz). The apparent brightness of the CCFL is controlled by the duty cycle of this switching operation. For example, if the CCFL is on longer than it is off during each dimming period, then the CCFL will appear brighter to the human eye. In contrast, if the CCFL is off longer than it is on during each dimming period, then the CCFL will appear dimmer to the human eye.

Proceeding to duty cycle dimming immediately after the CCFL strikes can cause the fault logic circuit to mistakenly view voltages at pins OVPL and CSDET as being system threatening, thereby triggering a shut down of the CCFL. To prevent an erroneous shut down, the CCFL can be kept at maximum brightness for 2 dimming cycles immediately after the first strike is detected. This provides a period of time for hard to start tubes to warm up before being turned off again for duty cycle dimming. Note that because standard dimming cycles are on the order of 6 mS, it is probable that 12 mS of maximum brightness as the CCFL turns on will be acceptable.

Referring to FIG. 6, post-strike period 603 therefore includes two full-scale brightness cycles immediately after strike, i.e. between times t2–t4. Brightness cycles are determined by the voltage ramps generated at pin CT1, wherein the voltage varies from 0 to a high voltage (e.g. 3 V) based on the charging/discharging cycle of capacitor 336 and the operation of dimming circuit 534 (see FIGS. 3 and 7). To ensure two full-scale brightness cycles, fault logic circuit 541 (FIG. 5) generates a low REC_SSV signal (thereby providing a high SSV signal for the two cycles, i.e. between times t2/t3 and t3/t4).

After the two maximum brightness cycles, fault control logic 541 can commence standard duty cycle dimming control as indicated by the voltage on pin SSV (which is provided by an appropriate RES_SSV signal) during period 604. In this embodiment, a user-supplied voltage can set the brightness of the CCFL by determining the duty cycle of the dimming period. Note that in FIG. 6 the voltage at pin BRIGHT is superimposed on the voltages monitored at pin CT1 to clarify timing of subsequent transitions in the voltages at pins SSV, SSC, and CSDET. Specifically, when the voltage at pin CT1 exceeds the voltage on pin BRIGHT (assuming BRPOL is connected to VSS), fault logic circuit 541 is triggered to generate a high RES_SSV signal (thereby providing a low SSV signal, which corresponds with the off portion of the duty cycle) and a high RES_SSC signal (thereby providing a low SSC signal) in order to set the BLANK signal high in preparation for the start of the next dimming cycle.

In CCFL system 300, the voltage on pin SSC can indicate blanking periods. Blanking periods indicate when otherwise unacceptable conditions in the direct drive CCFL circuit are acceptable. For example, in duty cycle dimming period 604, the voltage on pin CSDET falls below 1.25 V at the beginning of the each brightness cycle because the CCFL is actually turned off and the tube current during those times is zero. By occurring inside a blanking interval this apparent fault condition is interpreted correctly as normal operation. However, if this condition occurs outside the blanking period for more than a predetermined number of clock cycles (e.g. 4 clock cycles), then the CCFL is malfunctioning and should be shut down.

To provide this blanking period and referring to FIG. 5, comparator 525 compares the voltage on pin SSC to a reference voltage, i.e. in this case, 3 V. If the voltage on pin SSC falls below 3 V, then error amplifier 525 notifies fault logic circuit 541 of this condition using signal BLANK. In FIG. 6, this condition occurs during periods E and F, which represent two blanking periods. Note that faults are also blanked for the entire initial start up period although the timing diagram of FIG. 6 does not explicitly show blanking during period 601.

Note that other conditions monitored by fault logic circuit 541 can also be ignored during these blanking periods. For example, if the voltage on pin OVPL is greater than 2.5 V during a blanking period, then fault logic circuit 541 can ignore this condition. Other conditions monitored by fault logic circuit 541 are not ignored irrespective of blanking periods. For example, if the voltage on pin OVPH is greater than 3.3 V, then fault logic circuit 541 issues a command to shut down the direct drive CCFL system.

In one embodiment, the polarity of the dimming control can be user-controlled. In one case, as the user-supplied voltage increases, so does the brightness of the CCFL. However, in other cases, the user would prefer that the brightness of the CCFL decrease as the user-supplied voltage increased. To provide this selection, CCFL system 300 can include a control pin BRPOL that allows the user to set whether the tube brightness should be proportional or inversely proportional to the user-supplied brightness voltage.

Figure 7:
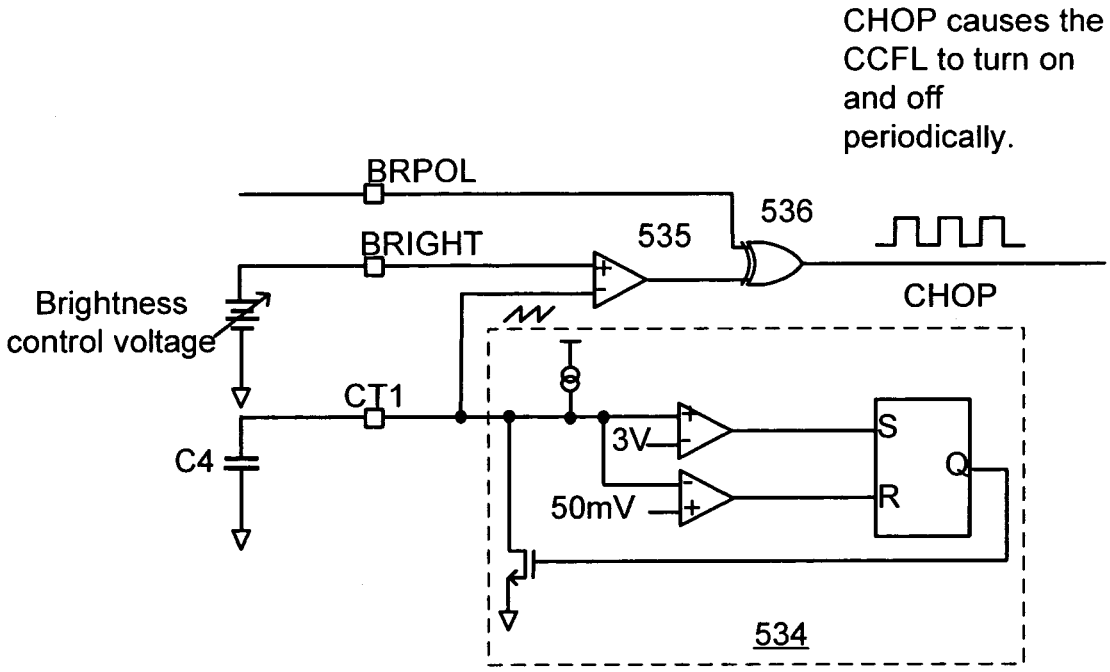
FIG. 7 illustrates one embodiment of dimming circuitry that allows the brightness polarity to be selectable.

FIG. 7 illustrates one embodiment of dimming circuitry 534 that allows the brightness polarity to be selectable. In this embodiment, dimming circuitry 534 is a relaxation oscillator that provides a voltage ramp on the CT1 pin. The voltage ramp is compared to the voltage on the BRIGHT pin by comparator 535 in order to provide the slow PWM signal that controls the CCFL brightness. In this embodiment, if the voltage at pin BRPOL is low, then the CCFL brightness is proportional to the voltage at pin BRIGHT. In contrast, if the voltage at pin BRPOL is high, then the CCFL brightness is inversely proportional to the voltage at pin BRIGHT.

Figure 8:
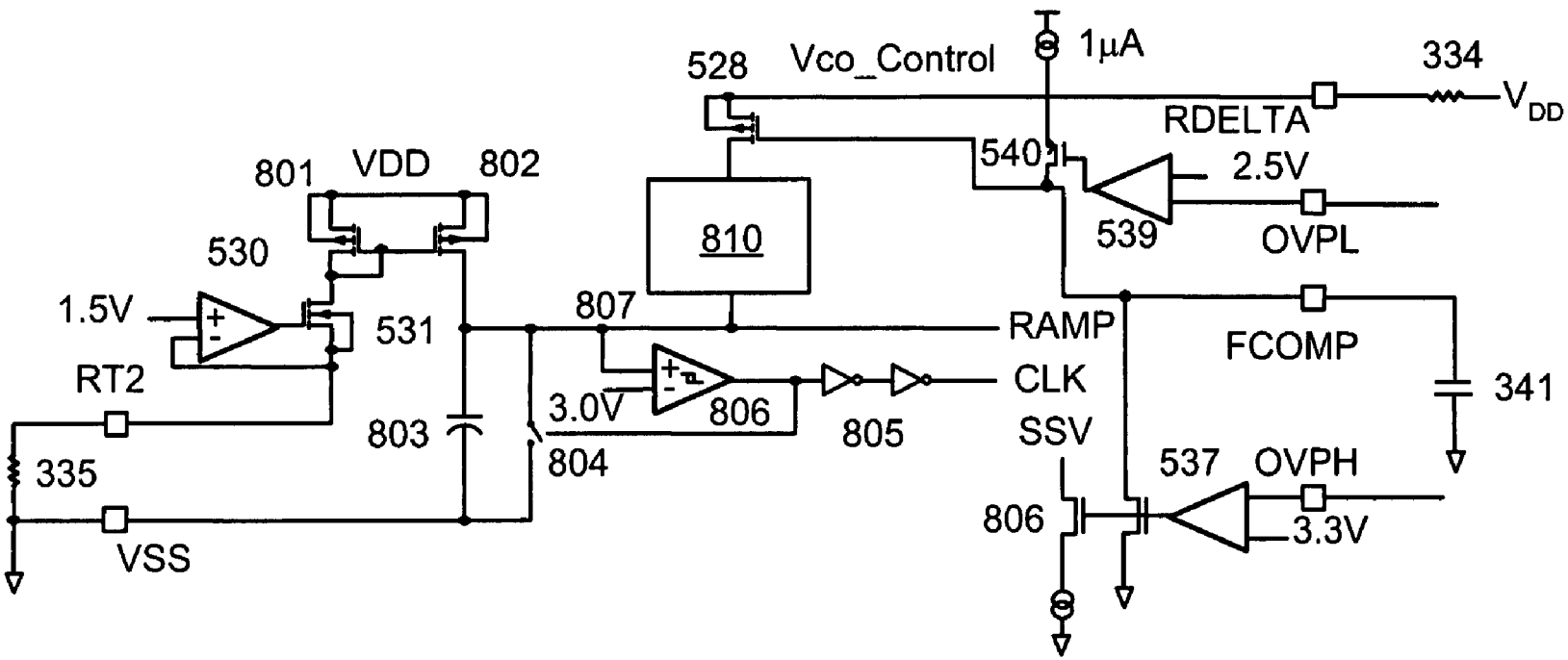
FIG. 8 illustrates one embodiment of a VCO.

FIG. 8 illustrates one embodiment of VCO 529 in the context of other components of CCFL system 300. In this embodiment, error amplifier 530 is configured to receive a reference voltage (e.g. 1.5 V) and the signal at the source of NMOS transistor 531. Error amplifier 530 provides its output signal to the gate of NMOS transistor 531. In this configuration, the current through NMOS transistor 531 is equal to the 1.5 V reference voltage divided by the resistance of resistor 335.

The current through NMOS transistor 531 is then mirrored using PMOS transistors 801 and 802 onto a capacitor 803. That current charges capacitor 803, thereby increasing the voltage at a positive input terminal to error amplifier 806 (node 807). Specifically, the voltage ramps up to a predetermined voltage determined by error amplifier 806, which also receives another reference voltage (e.g. 3.0 V). When the voltage on node 807 reaches the predetermined voltage, error amplifier 806 outputs a signal to close a switch 804, thereby discharging capacitor 803 to VSS (e.g. ground). Therefore, in this configuration, capacitor 803, error amplifier 806, and switch 804 form a standard relaxation oscillator. Note that the output of error amplifier 806 is also buffered using inverters 805 to provide the clock signal CLK. Further note that the ramping signal generated at node 807, i.e. signal RAMP, can be used to create the frequency of the PWM signal.

In one embodiment, a current divider 810, a PMOS transistor 528, and error amplifiers 539/537 can be used to add some current to node 807, thereby increasing the frequency of the RAMP signal. In this embodiment, comparator 539 turns PMOS transistor 540 on and off in response to the voltage at pin OVPL. A comparator 538 can be used to detect faults during steady state operation.

As the voltage at pin RDELTA decreases, more current flows across resistor 334 into current divider 810. Resistor 334, which is coupled to VDD, controls how much the oscillator frequency increases as a function of the voltage at the FCOMP pin. In one embodiment, current divider 810 divides the current by a factor of 50, thereby ensuring the amount of current added to that already present on node 807 is quite small.

Current LCD monitors may require multiple CCFL tubes to provide the high intensity light necessary for their intended application. Unfortunately, simply paralleling tubes with a single larger transformer is not advisable because differences in the load characteristics of the tubes may cause large mismatches in tube current and subsequent early tube failure. Alternatively, a single controller, single transformer can be used for each CCFL tube in the application; however, the cost of this type of application would soon become prohibitive.

Figure 9:
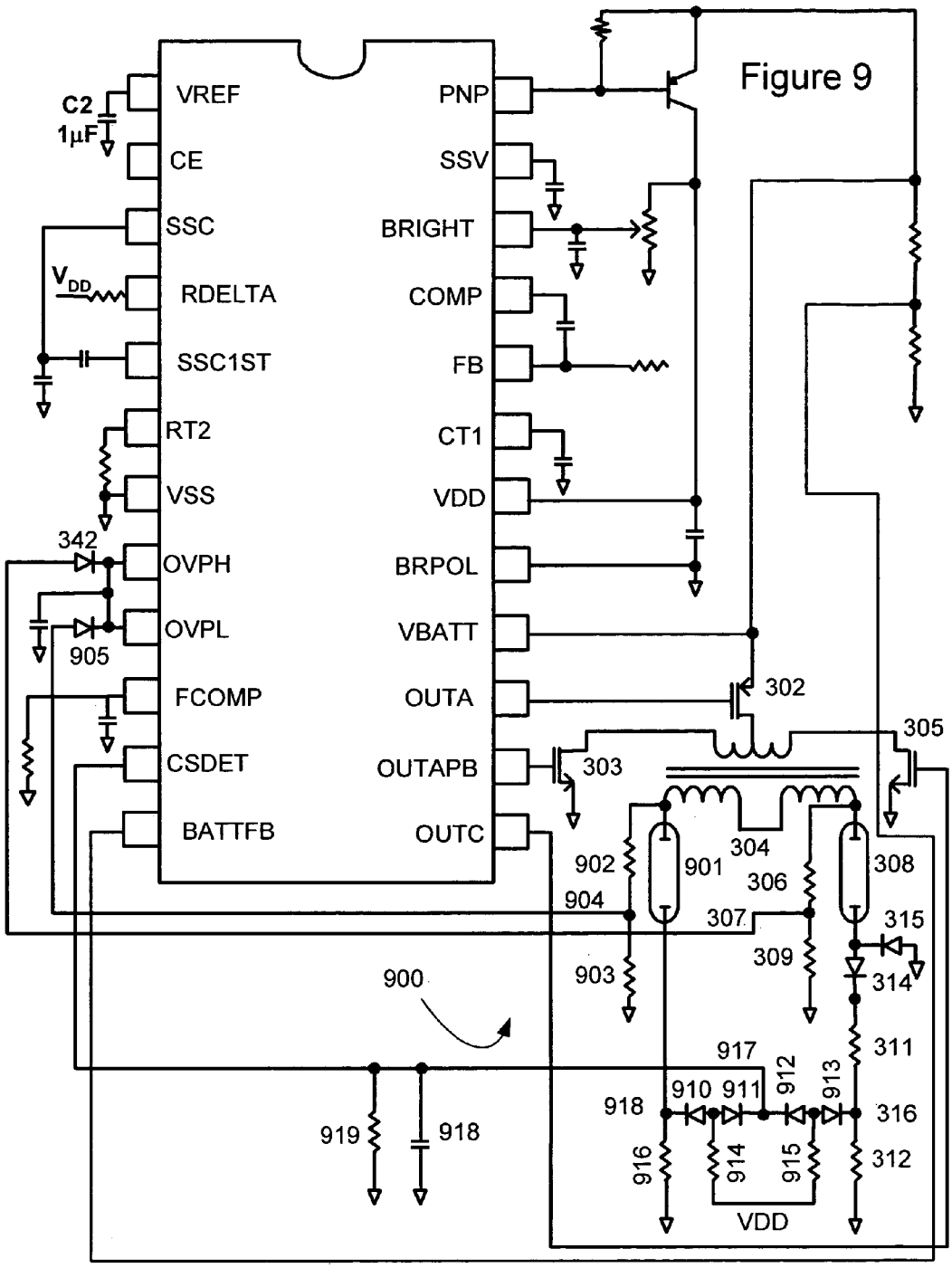
FIG. 9 illustrates a CCFL driving circuit that can drive two CCFL tubes.

FIG. 9 illustrates a CCFL driving circuit 900 that can drive two CCFL tubes (i.e. CCFL tubes 308 and 901) in series, but avoids the above pitfalls. Because CCFL tubes 308 and 901 are in series their current should be substantially the same. Note that in an actual application, the parasitic capacitances can cause the tube currents to be unequal, thereby underscoring the need to match the parasitic paths as closely as possible.

In circuit 900, with the exception of another secondary winding added to the transformer and the components associated with additional tube 901, the topology is substantially the same as for CCFL driving circuit 301 (see FIG. 3). The configuration and operation of PMOS transistor 302 and NMOS transistors 303 and 305 are identical to that in CCFL driving circuit 301, although these components may need to be resized due to the increased current in a two-tube application. Note that the feedback loop for determining the current through CCFL 901 is identical to that in CCFL driving circuit 301 because, as long as the parasitic capacitive paths are approximately equal for both tubes, the current in CCFL 901 should be substantially identical to the current in the regulated tube, i.e. CCFL 308.

The current flowing through resistors 902 and 903 can be sensed at node 904 and then converted from AC to DC using a rectifier (e.g. using a diode 905 shown) to provide a voltage (at pins OVPH and OVPL) that is proportional to the input voltage of CCFL 901. In FIG. 9, both pins OVPH and OVPL are shorted together. In other embodiments, pins OVPH and OVPL could be driven from different locations on the resistor divider strings including resistors 902, 903, 306, and 309. Driving pins OVPL and OVPH separately could provide more flexibility in tailoring the startup frequency to different CCFL input voltages.

The secondary windings are wound so that the outputs to the CCFLs are of opposite phase, although this is not strictly necessary. When the voltage at one secondary output is high (e.g. +600 volts) the other secondary output should be low (e.g. −600 volts). The secondary terminals that are not connected to the CCFLs are connected to each other. In a balanced circuit, the voltage at the connection of the two secondary windings will, ideally, be zero. In an actual implementation, the voltage at the connection of the two secondary windings can deviate somewhat from zero.

The multi-tube configuration is modular. Specifically, because each double transformer can drive two CCFLs, it is possible to construct 2, 4, 6, etc. tube solutions using the basic architecture shown in FIG. 9 (wherein the FETs can be properly sized to handle the increased current). Note that in a 4-tube configuration, the common secondary connection (i.e. the node NOT connected to the lamp) is made with the opposite transformer. In this way, the secondary current from the winding on the first transformer should be equal to the secondary current of its companion winding on the second transformer. In the case of 4 CCFLs driven by two transformers, there are two sets of common secondary nodes. This configuration is described in further detail in U.S. patent Ser. No. 10/264,438, entitled "Method and System of Driving a CCFL", filed by the Analog Microelectronics, Inc. on Oct. 3, 2002, and incorporated by reference herein.

Sensing the current in the multiple tube case may require some extra circuitry. Normally the CSDET pin checks for the existence (or absence) of current in the CCFL. If current is detected, then the initial start mode terminates and steady state operation begins. During steady state operation, if no current is detected for N consecutive clock cycles, then the circuit is shut down. Because only one CSDET pin is provided in this multiple tube embodiment, extra circuitry is required.

For example, the current through CCFL 308 is regulated by the control circuit. However, for purposes of fault detection and strike detection, it is beneficial to monitor the current through both CCFLs 308 and 901. In this case, resistor 916 can advantageously sense the current in the left tube in the same way resistor 312 senses the current in CCFL 901. If the current through either tube is zero, then resistors 916 and 312 will try to pull nodes 918 or 316, respectively, to zero. Resistors 914 and 915 attempt to pull nodes 918 and 316, respectively, up. However, resistors 914 and 915 (e.g. 10K Ohms) can be sized much larger than resistors 916 and 312 (e.g. 221 Ohms), thereby allowing nodes 918 and 316 to pull close to VSS when there is zero current in their respective CCFLs. The absence of current in either tube essentially pulls nodes 918 or 316 to VSS.

Figure 10A:
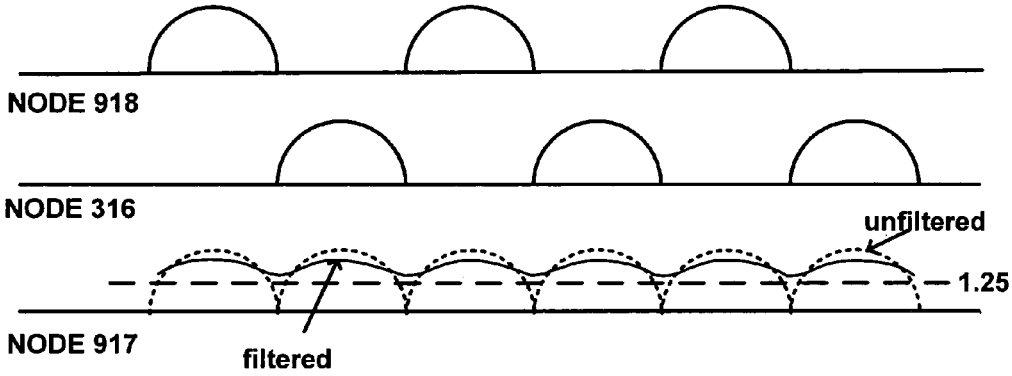
FIGS. 10A and 10B illustrate the voltages at various nodes in the CCFL driving circuit of FIG. 9.
Figure 10B:
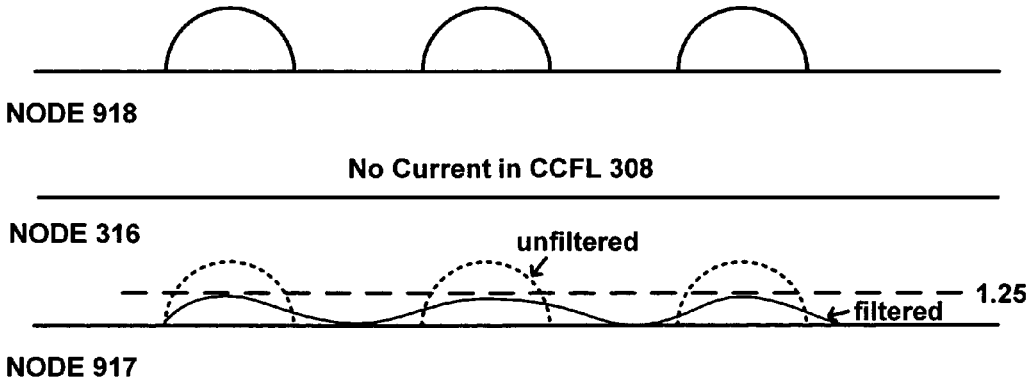

In normal operation, the voltage at nodes 918 and 316 should look like alternating, positive half sinusoids, as shown in FIG. 10A (assuming no faults). If, however, there is no current flowing in one of CCFLs 901 and 308, then one half of the sinusoids would be missing and the voltage at pin CSDET (i.e. node 917) would drop compared to its normal value, as shown in FIG. 10B. The values of the RC network including resistor 919 and capacitor 918 can be chosen so that the voltage at pin CSDET is always larger than 1.25 V when both half sinusoids are present, but is less than 1.25 V when only one sinusoid is present. This concept can be applied to any even multiple of tubes. Of importance, the tube without the current will dominate the voltage at pin CSDET. In this manner, a failure in any single tube will cause the circuit to shut down. In a similar manner, during start up all tubes must have current flowing in them before the voltage at pin CSDET will rise above 1.25V, thereby indicating that both tubes have struck and that the initial start up mode is complete.

Figure 11:
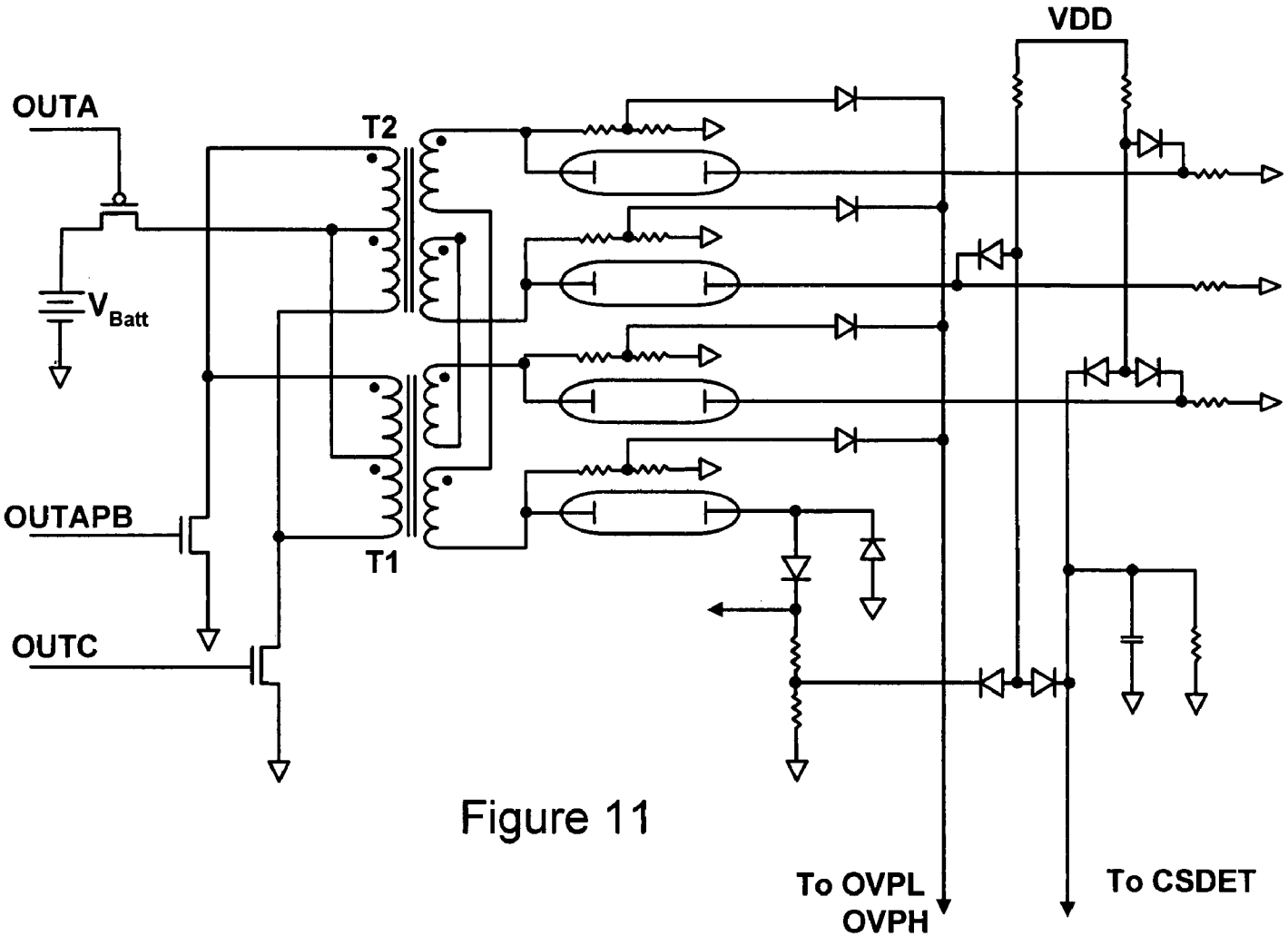
FIG. 11 illustrates a CCFL driving circuit that can drive four CCFL tubes.

In one embodiment, for every 2 extra CCFLs that need to be added, one more transformer, two resistor divider networks, and two diodes can be added (e.g. resistors 902, 903, 306, and 309 and diodes 342 and 905) to sense the CCFL voltage as well as two more diodes and two more resistors to sense the tube current (e.g. resistors 312 and 916 and diodes 910 and 913). Resistors 914, 915, and 919, diodes 911 and 912, and capacitor 918 do not need to be replicated every time more CCFLs are added because they are shared in common on the CSDET node 917. FIG. 11 illustrates an exemplary configuration of current and voltage sensing circuitry for a four-tube application.

OTHER EMBODIMENTS

Various embodiments of the present invention have been described herein. Those skilled in the art will recognize various component replacements or modifications that can be made to those embodiments. For example, voltage-sensing resistors 902, 903, 306 and 309 can be replaced by capacitors. Additionally, most of the techniques herein described could also be applied to a half bridge driving topology in which case a standard transformer could be used without the center tapped primary. The half bridge topology would also only require one external NMOS transistor instead of two. Therefore, the scope of the present invention is only limited by the appended claims.

The invention claimed is:

1. A method of improving a start up operation of a direct drive CCFL circuit, the method comprising:

driving a CCFL of the direct drive CCFL circuit at a switching frequency substantially different than a resonant frequency of the CCFL circuit; and allowing the switching frequency to approach the resonant frequency in a controlled manner, wherein allowing the switching frequency to approach resonant frequency in a controlled manner includes:

monitoring an input voltage and a current of the CCFL to determine whether the switching frequency is incrementally changed to approach resonant frequency, wherein monitoring includes:

determining whether the input voltage is equal to or less than a predetermined intermediate voltage and an output voltage of the CCFL, which is proportional to the current of the CCFL, is less than a predetermined low voltage; and if so, then incrementally changing the switching frequency to approach resonant frequency.

2. The method of claim 1, wherein monitoring includes:

determining whether the input voltage is greater than the predetermined intermediate voltage but less than a predetermined high voltage; and if so, then holding the switching frequency at its current value.

3. The method of claim 2, wherein monitoring further includes:

determining whether the input voltage is above the predetermined high voltage; and if so, then resetting the switching frequency to the frequency substantially different than a resonant frequency and restarting a duty cycle of a switching waveform from 0% and the allowing the duty cycle to increase.

4. The method of claim 3, wherein monitoring further includes:

determining whether the input voltage is equal to or less than the predetermined intermediate voltage and the output voltage is equal to or greater than the predetermined low voltage; and if so, then entering steady state operation.

5. The method of claim 4, wherein monitoring further includes:

setting a timer when start up begins;

determining whether the timer has expired when one of the input voltage is greater than the predetermined intermediate voltage and the output voltage is less than the predetermined low voltage; and if so, then shutting down the direct drive CCFL circuit.

* * * * *